US005399284A

United States Patent [19]

Schreiber

[11] Patent Number: 5,399,284

[45] Date of Patent: Mar. 21, 1995

[54] PROCESS FOR REMOVING STARCH-CONTAINING CONTAMINATION FROM DISHES AND SURFACTANT CONCENTRATES SUITABLE FOR THIS PROCESS

[75] Inventor: Olaf Schreiber, Hamburg, Germany

[73] Assignee: Chemische Fabrik Dr. Weigert (GmbH & Co.), Germany

[21] Appl. No.: 122,594

[22] PCT Filed: Apr. 3, 1991

[86] PCT No.: PCT/EP92/00700

§ 371 Date: Oct. 1, 1993

§ 102(e) Date: Oct. 1, 1993

[87] PCT Pub. No.: WO92/17564

PCT Pub. Date: Oct. 15, 1992

[30] Foreign Application Priority Data

Apr. 3, 1991 [DE] Germany ..... 41 10 764.0

[51] Int. Cl.[6] ..... C11D 3/386

[52] U.S. Cl. ..... 252/174.12; 252/DIG. 12; 252/542; 435/188; 435/219; 134/25.2

[58] Field of Search ..... 252/542, 174.12, DIG. 12; 435/188, 219; 134/25.2

[56] References Cited

U.S. PATENT DOCUMENTS

| | | | |
|---|---|---|---|
| 4,092,272 | 5/1978 | Nishimura et al. | 252/545 |
| 4,136,045 | 1/1979 | Gault et al. | 252/135 |
| 4,166,048 | 8/1979 | Nishimura et al. | 252/546 |
| 4,501,681 | 2/1985 | Groult et al. | 252/174.12 |
| 4,762,522 | 8/1988 | Mauc | 8/94.19 R |
| 5,035,859 | 7/1991 | Gu et al. | 422/28 |
| 5,078,301 | 1/1992 | Gladfelter et al. | 222/52 |
| 5,093,031 | 3/1992 | Login et al. | 252/357 |
| 5,133,892 | 7/1992 | Chun et al. | 252/90 |

FOREIGN PATENT DOCUMENTS

| | | |
|---|---|---|
| 1728093 | 3/1972 | Germany . |
| 3246389 | 9/1983 | Germany . |
| 88/00184 | 1/1988 | WIPO . |

*Primary Examiner*—Paul Lieberman
*Assistant Examiner*—Kery Fries
*Attorney, Agent, or Firm*—Haverstock, Medlen & Carroll

[57] ABSTRACT

A process for removing especially starch-containing impurities from crockery in dishwashers makes it possible effectively to remove the impurities if a concentrated aqueous tenside solution is used which contains 0.08 to 2.0 % wt, N-$C_8$ to $C_{12}$ alkyl pyrrolidone, 0.005 to 0.125 Artson units of one or more proteases and/or 0.1 to 6 kilo-novo units or one or more amylases per liter of solution, buffer substances active in the pH range from 5 to 9 and conventional solvent agents and possibly conventional additives like foam suppressors, perfumes, colorants, thickening agents, preserving agents and hardness dispersants.

36 Claims, No Drawings

PROCESS FOR REMOVING STARCH-CONTAINING CONTAMINATION FROM DISHES AND SURFACTANT CONCENTRATES SUITABLE FOR THIS PROCESS

Process for removing starch-containing contamination from dishes and surfactant concentrates suitable for this process The invention relates to a process for removing, in particular, starch-containing contamination from dishes in dishwashers comprising the steps of:

a) mechanical precleaning of the dishes to remove coarse contamination, b) spraying of the dishes with a concentrated surfactant solution, c) leaving the surfactant solution to act at temperatures in the range between ambient temperature and about 60° C. for a period of time in the range from 5 to 300 seconds, d) mechanical cleaning of the dishes with customary detergents which are compatible with the surfactant of the concentrated surfactants solution and rinsing clean.

In the foodstuffs processing sector of industry, including the kitchen sector, more or less alkaline detergent formulations which, in addition to the builder substances usually present, contain oxidising agents in the form of peroxides or active chlorine compounds are employed for mechanical cleaning of dishes. The known detergents have the common factor that because of their alkaline formulation, they cause pollution of the waste water. However, detergent solutions which are in some cases highly alkaline are required specifically for cleaning dishes with starch-containing contamination, since the action times provided in modern dishwashers are very short. Nevertheless, the cleaning quality which can be achieved with these detergent solutions is unsatisfactory; although it is possible to remove the majority of the starch-containing contamination, a thin deposit of starch-containing material often remains on the dishes, which, as the length of time over which the dishes are used increases, can no longer be removed by the route of customary cleaning of dishes. This also applies to those processes in which the precleaned dishes are sprayed directly with relatively highly dosed alkaline detergents, which is followed by an action time which can be several seconds to several minutes. Furthermore, the presence of concentrated alkaline solutions in dishwashers intended for this purpose results in a not inconsiderable potential hazard to the operating staff.

The invention accordingly relates to a process of the abovementioned type, in which contamination, in particular starch-containing contamination, which results in kitchens, can be removed effectively without the abovementioned deposits forming, although a concentrated surfactant solution having a pH in the weakly acid to weakly alkaline range is used in this process.

This object is achieved according to the invention by a process in which the concentrated surfactant solution used is an aqueous solution which contains f) 0.08 to 2.0% by weight of N-$C_8$- to $C_{12}$-alkylpyrrolidones, g) 0.005 to 0.125 Anson units of one protease or more and/or 0.1 to 6 kilo-Novo units of one amylase or more per l of surfactant solution, h) buffer substances which act in the pH range from 5 to 9 and i) customary solubilising agents, and if appropriate k) customary additives, such as foam suppressants, fragrances, dyestuffs, thickeners, preservatives and hardness-dispersing agents.

The N-$C_8$ to $C_{12}$-alkylpyrrolidones contained in the concentrated surfactant solutions to be used according to the invention, in particular those having straight-chain alkyl groups, are commercially available compounds which have hitherto been employed mainly as surface-active agents in cosmetics formulations.

The proteases and/or (preferably) amylases to be employed according to the invention, which can be added individually or as a mixture, are commercially available enzyme systems.

As solubilising agents to be employed in the surfactant solutions to be used according to the invention, there may be mentioned in particular short-chain sulphonates and sulphates, which are likewise known compounds.

Typical examples of foam suppressants which are to be added to the surfactant concentrates of the invention, if appropriate, are biologically degradable adducts of ethylene oxide and propylene oxide on fatty alcohols having turbidity points in water of $\leqq 50°$ C., or of propylene oxide on fatty alcohols. Ethylene oxide/propylene oxide adducts on fatty alcohols which are commercially available block adducts of a numerical average of 2 to 5 mol of ethylene oxide and 2 to 4 mol of propylene oxide on 1 mol of fatty alcohols having 12 to 18, in particular 12 to 14, carbon atoms are particularly preferred; the surfactant concentrates can contain them in an amount of 1 to 3% by weight. The abovementioned foam suppressants are commercially available compounds which have a foam-suppressing action at the normal operating temperatures of a dishwasher (about 50° to 60° C.); if appropriate, the surfactant concentrates can contain other, likewise customary foam suppressants if necessary. The optimum amount of foam suppressants to be added depends on the chain length of the N-alkyl-pyrrolidones; longer-chain compounds may require higher contents of the foam suppressants.

According to a preferred embodiment of the invention, the concentrated surfactant solution has a content of N-$C_8$-$C_{12}$-alkylpyrrolidones in the range from 0.08 to 1.0% by weight.

According to another advantageous embodiment of the invention, the concentrated surfactant solution has a content of proteases in the range from 0.005 to 0.125 Anson unit per l of solution.

According to another, particularly advantageous embodiment of the invention, the concentrated surfactant solution has a content of amylases in the range from 0.15 to 2.0 kilo-Novo units per l of solution.

According to another advantageous embodiment of the invention, the concentrated surfactant solution has a pH, adjusted by means of buffer substances, in the range from 6 to 8; buffer systems which are suitable for this purpose, for example $NaHCO_3/Na_2CO_3$, are familiar to the expert.

According to another advantageous embodiment of the invention, the concentrated surfactant solution is allowed to act on the mechanically precleaned dishes at temperatures in the range from 30° to 60° C. for a period of time in the range from 10 to 90 seconds.

After the use according to the invention of the weakly acid to weakly alkaline concentrated surfactant solutions, the dishes are subjected to final cleaning in a manner which is known per se, for example according to the abovementioned prior art, by customary cleaning steps, including rinsing clean.

It is moreover not necessary to carry out the stages of mechanical precleaning and if appropriate also spraying on of the surfactant solutions to be employed according to the invention and the action thereof in the same machine; it is possible to carry out these steps at workstations provided before the actual dishwasher.

The invention furthermore relates to an aqueous surfactant concentrate containing, if appropriate after dilution with water, a) 0.08 to 2.0% by weight of N-$C_8$- to $C_{12}$-alkylpyrrolidones, b) 0.005 to 0.125 Anson unit of one protease or more and/or 0.1 to 6 kilo-Novo units of one amylase or more, c) buffer substances which act in the pH range from 5 to 9, d) customary solubilising agents and if appropriate e) customary additives, such as foam suppressants, fragrances, dyestuffs, thickeners, preservatives and hardness-dispersing agents.

Other advantageous embodiments of the aqueous surfactant concentrate of the invention can be seen from the features .further explained above in respect of the process in which they are used.

The invention is illustrated in more detail below with the aid of a preferred embodiment example.

A Winterhalter WKTS-PWZNT 2600 2-tank box transportation machine equipped with a spray device, for spraying on the aqueous surfactant concentrates of the invention, upstream of the cleaning tank for accommodating customary detergents compatible with surfactants of the concentrated surfactant solution was used for carrying out the process of the invention. The water supply was softened Hamburg mains water (<0.1 mmol Ca/l). In the final stage, customary rinse aids having a concentration of 0.3 g/l were used; the nature of the rinse aid is independent of the result of the removal which is sought of the starch deposits.

Ceramic dishes, originating from a canteen, which had starch deposits covering at least 50% of the surface were used as the goods to be washed; these goods to be washed essentially correspond to those obtained after mechanical precleaning to remove coarse contamination by spraying with water, the starch deposits of which can be removed effectively in accordance with the prior art only by using strongly alkaline detergents.

An aqueous surfactant concentrate having the following composition was first prepared:

25 g of a commercially available block adduct of 5 mol of ethylene oxide and 4 mol of propylene oxide on an industrial C12/C14 fatty alcohol having a turbidity point in water of 28°–32° C. (foam suppressant), 1 g of N-n-octylpyrrolidone, 5 g of a commercially available aqueous solution of a mixture of amylases and proteases having an activity of 1.5 Anson units and 50 kilo-Novo units per liter, 0.4 g of sodium bicarbonate and 0.1 g of sodium carbonate, made up to a volume of 100 ml with Hamburg mains water; a commercially available polyacrylate dispersing agent was added to this concentrate to a concentration of 100 ppm, and the concentrate had a pH of 7.2 +/−0.4. Before the test dishwasher was charged, this concentrate was diluted with water to a total volume ratio of 1,000 ml.

The concentrated surfactant solution thus obtained was sprayed onto the dishes, which were heated to a temperature of about 40°–45° C. in the abovementioned test machine. After an action time of 15 seconds, they were washed "normally" with a commercially available dishwashing agent at 60° C., this being followed by a rinsing step with a similarly customary clean-rinsing agent.

Investigation of the dishes treated in this way for starch deposits by means of a 0.5% strength iodine solution showed that the starch deposits had been removed completely.

I claim:

1. A method for removing contamination from dishes in dishwashers comprising the steps of:

a) providing a buffered surfactant solution comprising one or more N-alkylpyrrolidones at a concentration range of 0.98% to 2.0% by weight and one or more enzymes selected from the group consisting of proteases at a concentration of 0.005 to 0.1.25 Anson units and amylases at a concentration range of 0.1 to 6 kilo-Novo units; and b) exposing said dishes to said surfactant solution, under conditions where said contamination is removed.

2. The method of claim 1, wherein said N-alkylpyrrolidone is an N-n-($C_8$- to $C_{12}$-)-alkylpyrrolidone.

3. The method of claim 1, wherein said surfactant solution further comprises one or more buffers active within a pH range of 5 to 9.

4. The method of claim 3, wherein said surfactant solution further comprises one or more additives selected from the group consisting of foam suppressants, fragrances, dyestuffs, thickeners, preservatives and hardness-dispersing agents.

5. The method of claim 4, wherein said additive is a foam suppressant comprising ethylene oxide/propylene oxide adducts on fatty alcohols.

6. The method of claim 5, wherein said fatty alcohols contain 12 to 14 carbon atoms.

7. The method of claim 4, wherein said surfactant solution further comprises solubilizers selected from the group consisting of sulfones and sulfates.

8. The method of claim 1, wherein said exposure is conducted within the range of ambient temperature and 60° C.

9. The method of claim 8, wherein said exposure comprises spraying said dishes for 5–300 seconds with said surfactant solution.

10. The method of claim 1, wherein said exposure occurs after said dishes are mechanically pre-cleaned.

11. The method of claim 1, wherein said dishes are mechanically cleaned with detergent after said exposure.

12. The method of claim 11, wherein after said mechanical cleaning, said dishes are rinsed.

13. A method for removing starch-containing contamination from dishes in dishwashers comprising the steps of:

a) providing a buffered surfactant solution comprising one or more N-n-($C_8$- to $C_{12}$-)-alkylpyrrolidones, one or more proteases and one or more amylases;

b) exposing said dishes to said surfactant solution;

c) mechanically cleaning said dishes in the presence of a detergent; and d) rinsing said dishes.

14. The method of claim 13, wherein said N-n-($C_8$- to $C_{12}$-)-alkylpyrrolidone comprises of 0.08 to 2.0% of said surfactant solution by weight.

15. The method of claim 14, wherein said surfactant solution further comprises one or more buffers active in a pH range of 5 to 9.

16. The method of claim 15, wherein said surfactant solution further comprises one or more additives selected from the group consisting of foam suppressants, fragrances, dyestuffs, thickeners, preservatives and hardness-dispersing agents.

17. The method of claim 16, wherein said additive is a foam suppressant comprising ethylene oxide/propylene oxide adducts on fatty alcohols.

18. The method of claim 17, wherein said fatty alcohols contain 12 to 14 carbon atoms.

19. The method of claim 13, wherein said surfactant solution further comprises solubilizers selected from the group consisting of sulfones and sulfates.

20. The method of claim 13, wherein said exposure is conducted within the range of ambient temperature and 60° C.

21. The method of claim 20, wherein said exposure is conducted within the temperature range of 40°–45° C.

22. The method of claim 13, wherein said exposure comprises spraying said dishes for 5–300 seconds.

23. The method of claim 22, wherein said exposure comprises spraying said dishes for 15 seconds.

24. The method of claim 13, wherein said exposure occurs after said dishes are mechanically pre-cleaned.

25. A method for removing starch-containing contamination from crockery in dishwashers comprising the steps of:

a) providing a buffered surfactant solution comprising one or more N-n-($C_8$- to $C_{12}$-)-alkylpyrrolidones, one or more buffers, one or more proteases, one or more amylases, and one or more additives selected from the group consisting of foam suppressants, fragrances, dyestuffs, thickeners, preservatives and hardness-dispersing agents;

b) mechanically pre-cleaning said crockery;

c) exposing said crockery to said surfactant solution for approximately 5–90 seconds at a temperature of approximately 40°–60° C.;

d) mechanically cleaning said crockery in the presence of a detergent; and e) rinsing said crockery.

26. The method of claim 25, wherein said one or more N-n-($C_8$- to $C_{12}$-)-alkylpyrrolidones are present at a concentration of 0.08 to 2.0% by weight.

27. The method of claim 26, wherein said one or more proteases are present at an activity level of 0.005 to 0.125 Anson units per liter of said surfactant solution.

28. The method of claim 27, wherein said one or more amylases are present at an activity level of of 0.1 to 6 kilo-Novo units per liter of said surfactant solution.

29. The method of claim 28, wherein said surfactant solution further comprises a solubilizing agent selected from the group consisting of sulfates and sulfones.

30. The method of claim 25, wherein said surfactant solution further comprises a buffer selected from the group consisting of sodium salts.

31. A buffered surfactant solution, comprising 0.08 to 2.0% by weight N-n-($C_8$ to $C_{12}$)-alkylpyrrolidones, one or more proteases at a concentration range of 0.005 to 0.125 Artson units and one or more amylascs at a concentration range of 0.1 to 6 kilo-NOVO units.

32. The surfactant solution of claim 30, further comprising one or more buffers active in a pH range of 5 to 9.

33. The surfactant solution of claim 32, further comprising one or more additives selected from the group consisting of foam suppressants, fragrances, dyestuffs, thickeners, preservatives and hardness-dispersing agents.

34. The surfactant solution of claim 33, wherein said foam suppressants are comprised of ethylene oxide/propylene oxide adducts on fatty alcohols.

35. The surfactant solution of claim 34, wherein said fatty alcohols contain 12 to 14 carbon atoms.

36. The surfactant solution of claim 33, further comprising a solubilizing agent selected from the group consisting of sulfones and sulfates.

* * * * *

UNITED STATES PATENT AND TRADEMARK OFFICE

CERTIFICATE OF CORRECTION

PATENT NO. : 5,399,284

DATED : 03/21/95

INVENTOR(S) : Olaf Schreiber

It is certified that error appears in the above-indentified patent and that said Letters Patent is hereby corrected as shown below:

ON THE COVER PAGE, and column 1, line 1,

At "[54]", please delete "PROCESS FOR REMOVING STARCH-CONTAINING CONTAMINATION FROM DISHES AND SURFACTANT CONCENTRATES SUITABLE FOR THIS PROCESS" and insert --PROCESS FOR REMOVING STARCH-CONTAINING IMPURITIES FROM CROCKERY AND SUITABLE TENSIDE CONCENTRATES--.

At "[22]" please delete "Apr. 3, 1991" and insert --Mar. 30, 1992--.

On the title page item [57], line 6, delete "Artson" and insert --Anson--; and line 7, delete "units or one" and insert --units of one--.

In column 1, line 24, before "rinsing", please insert --e)--.

In column 3, line 25, please delete ".further" and insert --further--.

In column 4, line 18, please delete "0.98%" and insert --0.08%--.

In column 4, line 21, please delete "0.1.25" and insert --0.125--.

UNITED STATES PATENT AND TRADEMARK OFFICE

CERTIFICATE OF CORRECTION

PATENT NO. : 5,399,284

DATED : 03/21/95

INVENTOR(S) : Olaf Schreiber

It is certified that error appears in the above-indentified patent and that said Letters Patent is hereby corrected as shown below:

In column 6, line 25, please delete "Artson" and insert --Anson--.
In column 6, line 25, please delete "amylascs" and insert --amylases--.

Signed and Sealed this

Twenty-seventh Day of August, 1996

Bruce Lehman

*Attest:*

BRUCE LEHMAN

*Attesting Officer*

*Commissioner of Patents and Trademarks*